US012679591B1

(12) United States Patent
Kim

(10) Patent No.: US 12,679,591 B1
(45) Date of Patent: Jul. 14, 2026

(54) MODULAR MID-SECTION DETACHMENT SYSTEM FOR DRINKWARE BOTTLES AND CONTAINERS

(71) Applicant: Matthew Kim, Leonia, NJ (US)

(72) Inventor: Matthew Kim, Leonia, NJ (US)

( * ) Notice: Subject to any disclaimer, the term of this patent is extended or adjusted under 35 U.S.C. 154(b) by 31 days.

(21) Appl. No.: 19/056,751

(22) Filed: Feb. 19, 2025

Related U.S. Application Data

(60) Provisional application No. 63/722,019, filed on Jan. 15, 2025.

(51) Int. Cl.

| | |
|---|---|
| ***B65D 8/00*** | (2006.01) |
| ***B65D 23/00*** | (2006.01) |
| ***B65D 23/04*** | (2006.01) |
| ***B65D 23/10*** | (2006.01) |
| ***B65D 81/38*** | (2006.01) |
| *A47G 19/22* | (2006.01) |

(52) U.S. Cl.
CPC ..... *B65D 11/04* (2013.01); *B65D 23/001* (2013.01); *B65D 23/04* (2013.01); *B65D 23/10* (2013.01); *B65D 81/3865* (2013.01); *A47G 19/2261* (2013.01); *A47G 19/2272* (2013.01); *B65D 2255/06* (2013.01); *B65D 2313/04* (2013.01)

(58) Field of Classification Search
CPC .... B65D 21/083; B65D 81/361; B65D 11/04; B65D 23/001; B65D 23/04; B65D 23/10; B65D 81/3865; B65D 2255/06; B65D 2313/04; A47G 19/2261; A47G 19/2272
See application file for complete search history.

(56) References Cited

U.S. PATENT DOCUMENTS

| | | | | | |
|---|---|---|---|---|---|
| 3,695,476 | A * | 10/1972 | Ruekberg | B65D 41/32 | 215/220 |
| 4,625,885 | A * | 12/1986 | Nichols | B65D 55/06 | 292/307 R |
| 5,085,337 | A * | 2/1992 | Kos | B65D 43/0218 | 220/203.28 |
| 5,529,173 | A * | 6/1996 | Salacuse | B65D 75/22 | 206/315.1 |
| 5,678,472 | A * | 10/1997 | Millman | A47G 19/14 | 99/321 |
| 6,415,947 | B1 * | 7/2002 | Kim | B65D 43/0218 | 220/326 |
| 6,793,096 | B1 * | 9/2004 | Seok | B65D 43/0218 | 220/326 |
| 7,753,223 | B2 * | 7/2010 | Boozer | A47J 43/0727 | D7/378 |

(Continued)

*Primary Examiner* — Kareen K Thomas

(57) ABSTRACT

A modular container system comprising detachably connectable vessel portions that enable access to interior surfaces and reconfiguration into multiple functional container forms. The system includes standardized modular interfaces that allow vessel components to be separated, recombined, or interchanged to form various configurations such as bottles, cups, bowls, or general-purpose containers. Components may be structurally identical or distinct, and may be constructed from a range of materials tailored for hygienic, portable, or application-specific use. The modular interface may be positioned at any point along the vessel body to support reassembly and customization. The system supports user-driven customization across product lines and styles, offering a versatile platform for food and beverage storage, consumption, and portability applications.

20 Claims, 8 Drawing Sheets

(56) References Cited

U.S. PATENT DOCUMENTS

| | | | | |
|---|---|---|---|---|
| 7,854,344 | B2 * | 12/2010 | Suk | B65D 85/72 220/784 |
| 8,684,208 | B2 | 4/2014 | Hotell et al. | |
| D768,507 | S | 10/2016 | Hotell | |
| 9,506,798 | B2 * | 11/2016 | Saltzgiver | G01F 23/26 |
| 11,825,974 | B1 * | 11/2023 | Murphy | A47J 19/005 |
| 2006/0273059 | A1 * | 12/2006 | Mendenhall | A61J 11/0085 215/396 |
| 2009/0050598 | A1 * | 2/2009 | Huang | B65D 23/001 220/636 |
| 2010/0200438 | A1 * | 8/2010 | Davies | B65D 81/3205 220/4.27 |
| 2011/0166910 | A1 * | 7/2011 | Marina | B65D 51/2835 705/7.29 |
| 2012/0091131 | A1 * | 4/2012 | Arjomand | B65D 7/22 220/4.01 |
| 2012/0298659 | A1 * | 11/2012 | Bogner | B65D 71/502 220/200 |
| 2012/0325766 | A1 * | 12/2012 | Boisvert | B65D 81/361 215/10 |
| 2013/0087562 | A1 * | 4/2013 | Thukral | B65F 1/1615 220/210 |
| 2013/0111726 | A1 * | 5/2013 | Krieger | B65D 81/3823 29/428 |
| 2013/0270264 | A1 * | 10/2013 | Suljak | B65D 25/2811 220/4.03 |
| 2013/0341443 | A1 * | 12/2013 | Stephenson | A47G 19/2205 241/38 |
| 2014/0346072 | A1 * | 11/2014 | Jacobson | A61B 50/33 53/449 |
| 2015/0257557 | A1 * | 9/2015 | Mendoza | A47G 19/2272 220/4.28 |
| 2017/0113836 | A1 * | 4/2017 | Labedzki | B65D 11/04 |

* cited by examiner

MODULAR MID-SECTION DETACHMENT SYSTEM FOR DRINKWARE BOTTLES AND CONTAINERS

PROVISIONAL PRIORITY CLAIM

This application claims the benefit of U.S. Provisional Application No. 63/722,019, filed on Feb. 19, 2025, titled 'Modular Bottle with Mid-Section Detachment and Interchangeable Components for Customizable Size, Shape, and Conversion into Cup, Bottle, or Food Container,' the entirety of which is incorporated herein by reference.

FIELD OF THE INVENTION

This invention relates to modular containers and bottles featuring interchangeable segments and standardized coupling interfaces. More particularly, the invention provides a modular system enabling users to detach, reconfigure, and recombine container components of varying sizes, shapes, materials, and functionalities, resulting in customized vessels suitable for diverse personal, athletic, travel, and household uses.

BACKGROUND OF THE INVENTION

Conventional bottles and containers often feature limited functionality, primarily serving single-use purposes without meaningful opportunities for user-driven adaptation. While some container designs may include detachable components such as tops, bottoms, or removable inserts, these configurations are typically constrained to static functions and do not support the type of modular interchangeability or reconfiguration that this invention enables. Such prior designs generally do not allow components from one product to be rearranged, substituted, or combined with other vessels to form entirely new functional configurations. For example, a bottle with a removable base may not accommodate different materials, shapes, or coupling systems to transform into a bowl, thermal cup, or dual-compartment container. This invention introduces a modular bottle and container system that supports mid-section detachability and platform-based modularity. Vessel segments are designed to connect through standardized interfaces, enabling parts of different shapes, materials, or sizes to be substituted or rearranged across multiple configurations. The system allows the user to transform a single product into a bottle for athletic use, a soup container for camping, a baby feeding cup, or a travel-sized thermal vessel, depending on context.

SUMMARY OF THE INVENTION

The present invention introduces a modular bottle and container system incorporating a mid-section detachment interface that allows the user to separate and recombine multiple vessel components. This detachment capability enables not only improved access to the interior but also supports the rearrangement of parts into various functional configurations, including bottles, cups, bowls, or storage containers. The invention includes vessel portions that are connectable through one or more coupling mechanisms such as thread seals, snap-fit systems, or magnetic interfaces. These components may be composed of differing materials, including polymers, stainless steel, silicone, or thermal composites, depending on the intended use. The interface between modules allows for the integration of accessories or interchangeable bases and tops, offering both ergonomic and application-specific advantages. A key feature of the invention is its reconfigurability across vessels of varying volume, shape, material, or purpose. For example, a user may detach the lower half of a large insulated bottle and reattach a smaller base or substitute a mixing module containing a powder agitator or strainer. In another example, vessel halves from two differently styled bottles may be interchangeably combined to create a new aesthetic or functional setup. Unlike existing systems that may include detachable parts for cleaning or storage, this invention constitutes a modular platform with cross-compatibility and functional continuity across modules. The user may not only separate components but also build and expand their system using standardized coupling architecture, enabling an adaptive and expandable container ecosystem.

LIST OF REFERENCE NUMERALS

100—Modular detachment interface
101—Thread sealing system
102—Gasket
103—Thermal insulation wall
104—Ergonomic handle
105—Lid with straw
106—Modular filtration insert
107—Rotational locking mechanism
108—Secondary thread
109—Modular clip-lock mechanism
110—Magnetic sealing system
111—Powder agitator
112—Clip locking groove
113—Strap attachment

114—Integrated lid with grip feature
115—Universal lid or base
116—Integrated base support or coaster
117—Coupling gasket
201—Base module with open bottom
202—Base module with narrow bottom
203—Practical module with bottle neck
204—Practical module with handle
205—Base module with magnet and clip lock
206—Hybrid module A
207—Hybrid module B
208—Practical module with bottle neck and agitator

DETAILED DESCRIPTION OF THE INVENTION

In the following description of various example structures according to the invention, reference is made to the accompanying drawings, which form a part hereof and illustrate various example configurations, systems, and features in which aspects of the invention may be practiced. It is understood that other specific arrangements of components, configurations, and systems may be utilized, and structural and functional modifications may be made without departing from the scope of the present invention. Additionally, terms such as "top," "bottom," "front," "back," "side," "rear," and similar directional terms are used herein for convenience based on the example orientations shown in the figures or typical use cases and are not intended to limit the invention to any particular orientation. Nothing in this specification should be interpreted as requiring a specific three-dimensional orientation of components to fall within the scope of this invention. Furthermore, the attached drawings are not necessarily drawn to scale and are provided for illustrative purposes.

In general, aspects of this invention relate to modular containers and their associated detachment and reconfiguration system. According to various embodiments, the modular containers and their components described herein may be formed from one or more materials, including metals (e.g., stainless steel, aluminum, and metal alloys), polymers, composites, and elastomers, without departing from the scope of the invention. The components may also be formed using a variety of manufacturing techniques, such as forging, molding, casting, stamping, machining, extrusion, injection molding, blow molding, or other known methods.

The figures accompanying this application illustrate examples of modular containers and a modular detachment interface (100) according to the invention. The use of reference numbers is consistent throughout the specification and drawings, such that identical or similar components across different figures are identified by the same reference number for clarity and coherence.

Figure 1:
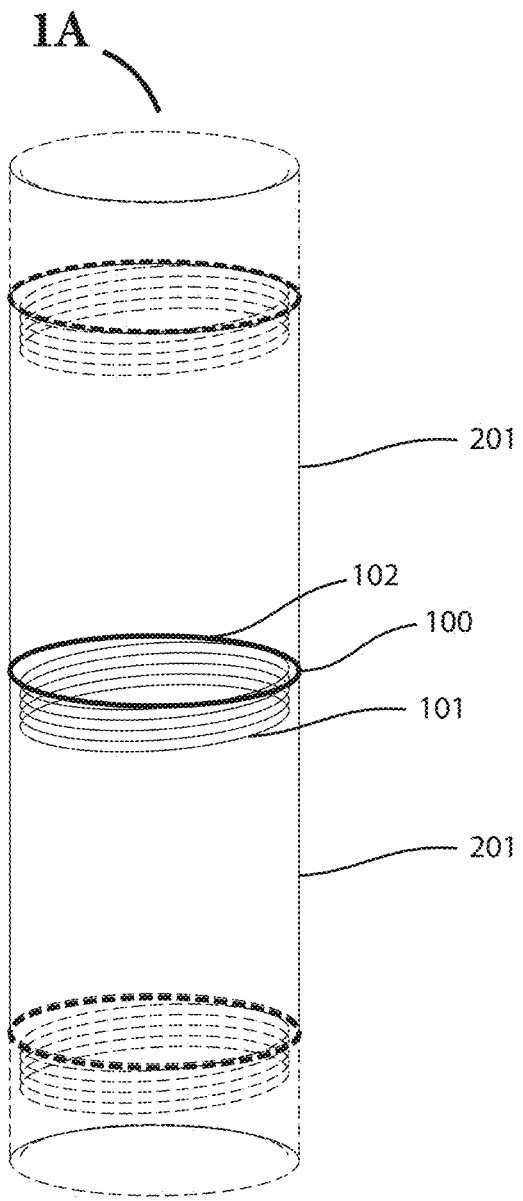
FIG. 1 illustrates a perspective view of a modular container in an assembled bottle configuration.
Figure 2:
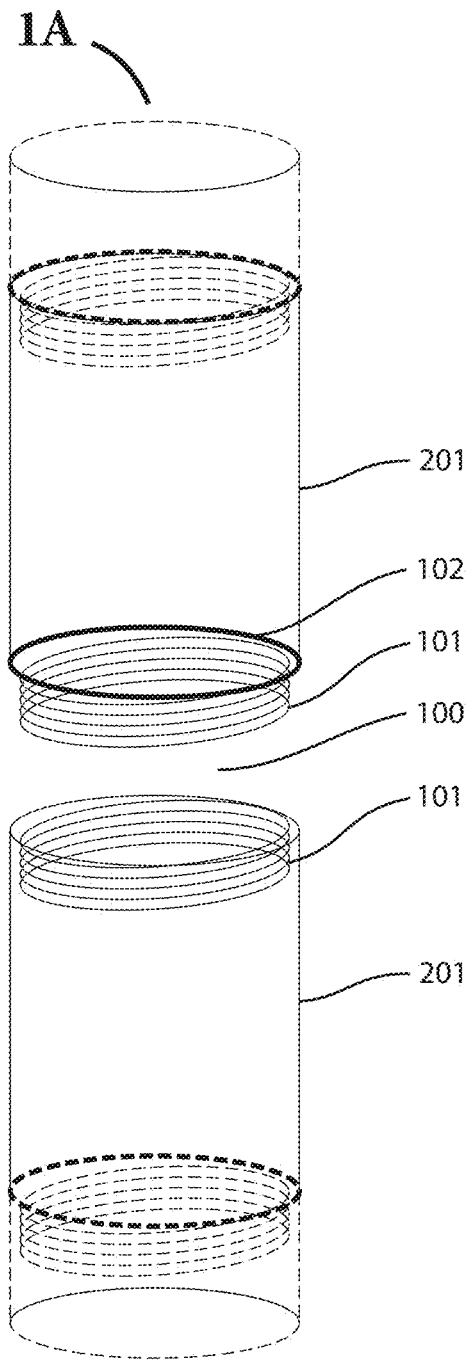
FIG. 2 illustrates an exploded view of vessel components showing the modular coupling interface.

FIG. 1 and FIG. 2 depict the modular bottle, referred to as Combination Module (1A), featuring the modular detachment interface (100). The bottle comprises a base module (201), modular detachment interface (100), gasket (102), and thread sealing system (101) to ensure a secure and leak-proof connection. The modularity of this design allows the container to be disassembled for thorough cleaning, addressing hygiene challenges associated with traditional bottles. The base module (201) can be interchanged with other components such as a thermal insulation wall (103) practical module with a bottle neck (203).

Figure 3:
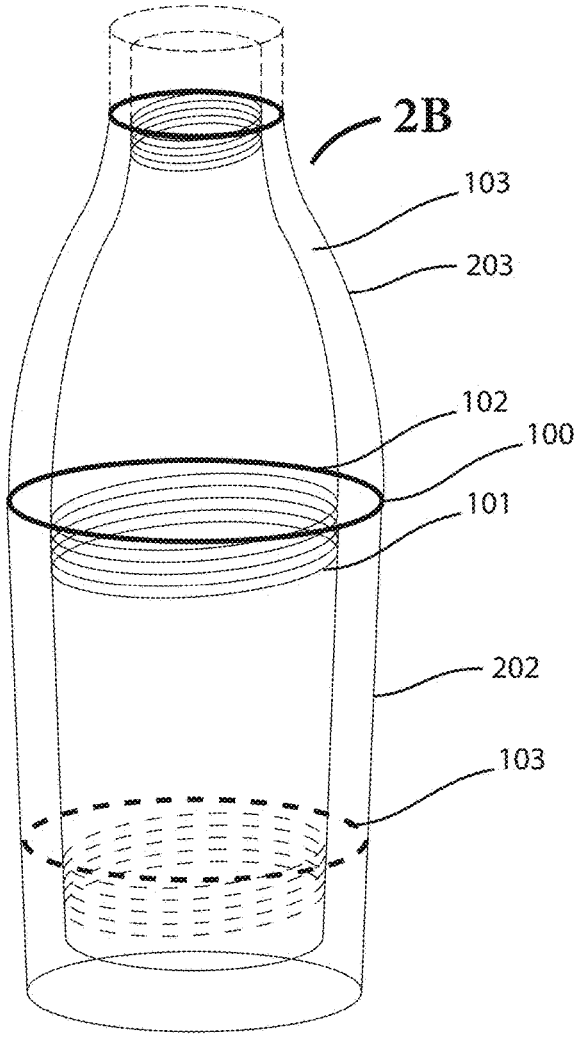
FIG. 3 illustrates the modular bottle with an integrated thermal insulation module and mid-section detachment.
Figure 4:
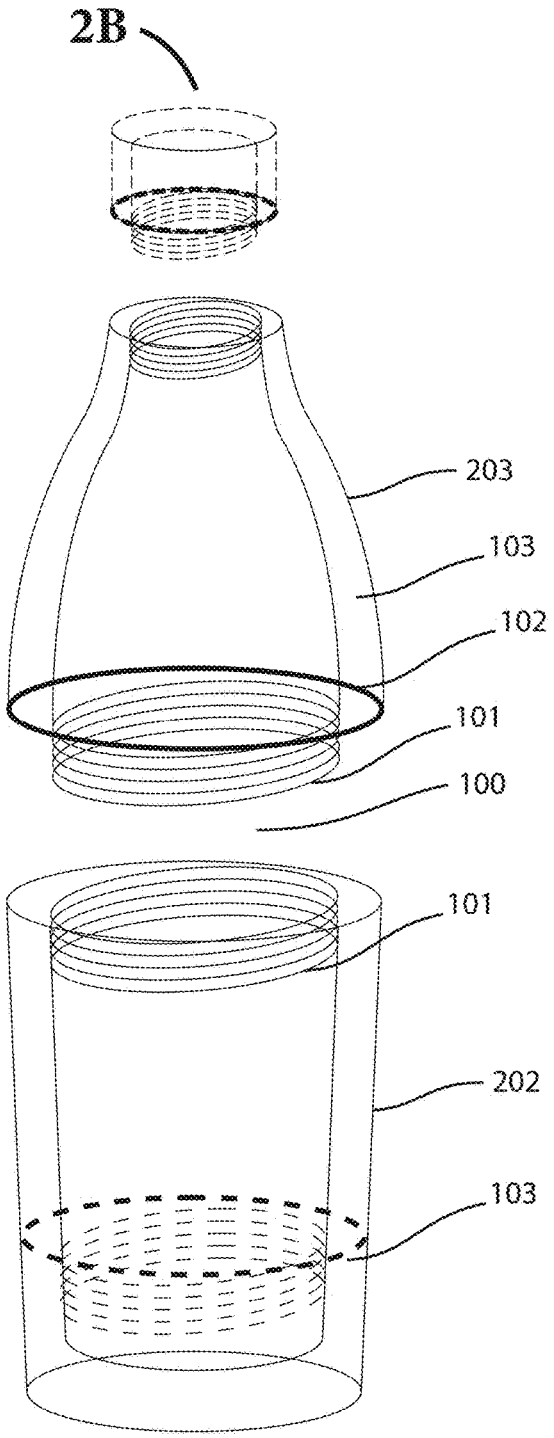
FIG. 4 illustrates an exploded configuration of the insulated modular bottle showing internal structure.

FIG. 3 and FIG. 4 illustrate Combination Module (2B), showcasing a thermal insulation wall (103) practical module with bottle neck (203) with the modular detachment interface (100). The thermal insulation wall (103) includes double-wall construction designed to maintain the temperature of the liquid contents.

Figure 5:
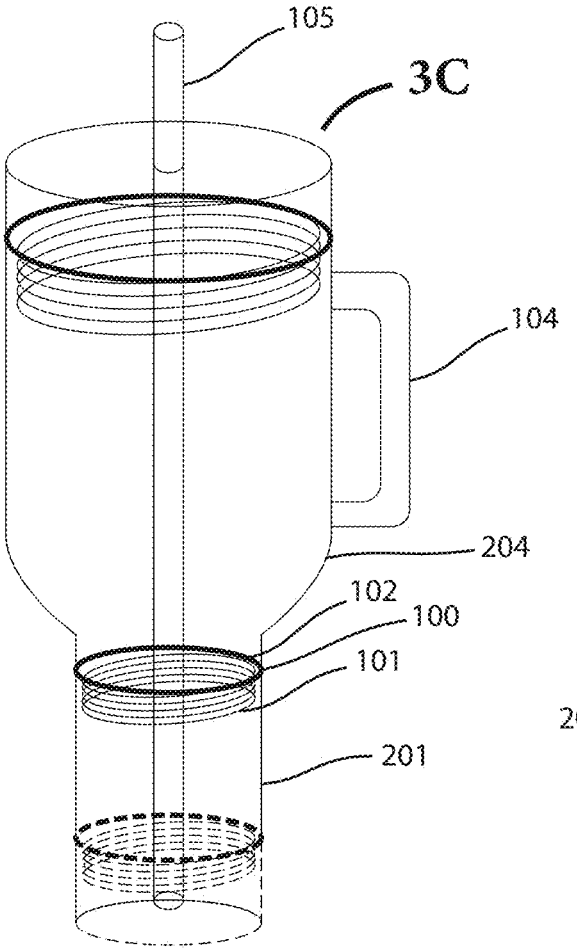
FIG. 5 illustrates a side view of a reconfigurable modular bottle with ergonomic features.
Figure 6:
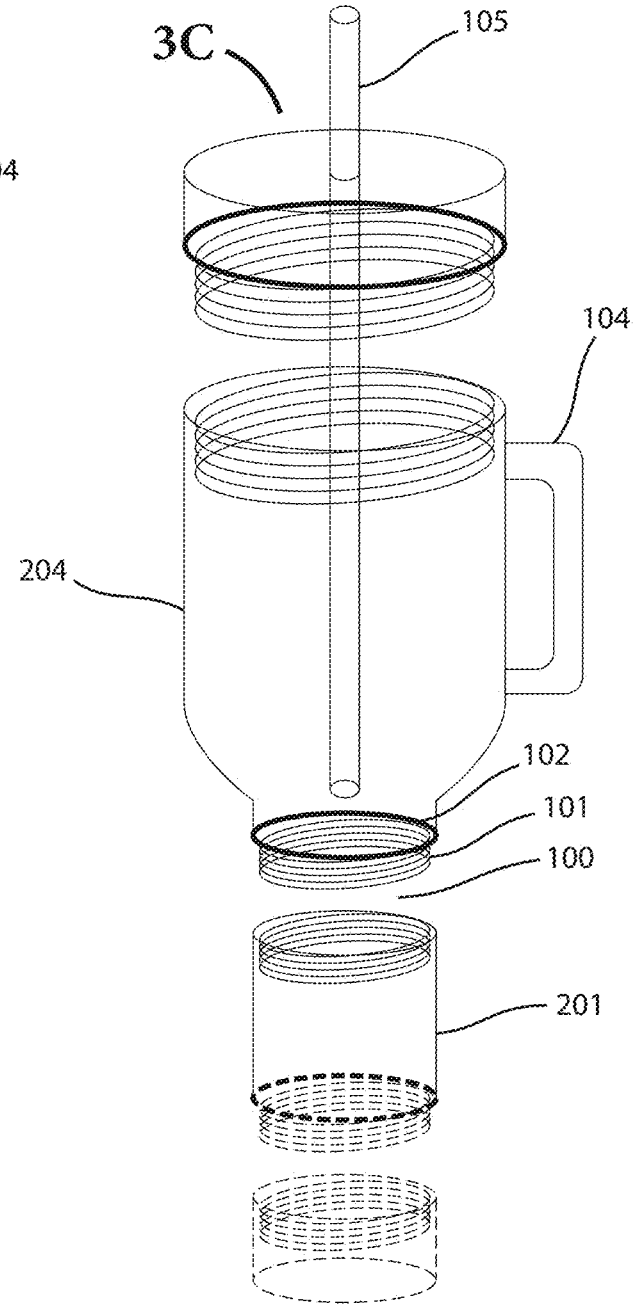
FIG. 6 illustrates an exploded view of a bottle configuration highlighting user-customizable parts.

FIG. 5 and FIG. 6 highlight Combination Module (3C), a modular bottle made from a practical module with ergonomic handle (104) and a lid with straw (105). This configuration showcases the flexibility of the modular detachment interface (100) in enabling portability and ease of use. The ergonomic handle (104) is designed for user comfort, while the lid with straw (105) allows convenient access to contents without fully detaching the lid. Accordingly, in one example, an individual may use Combination Module (3C) at work, and reassemble a new configuration such as (4D) for different use cases such as post-work activities.

Figure 7:
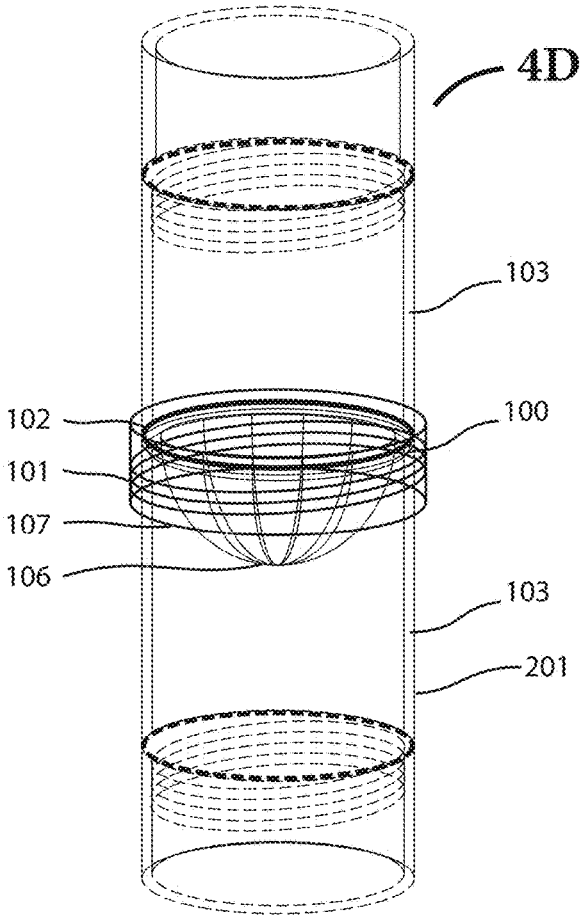
FIG. 7 illustrates an assembled view of a modular configuration with filtration and detachment capability.
Figure 8:
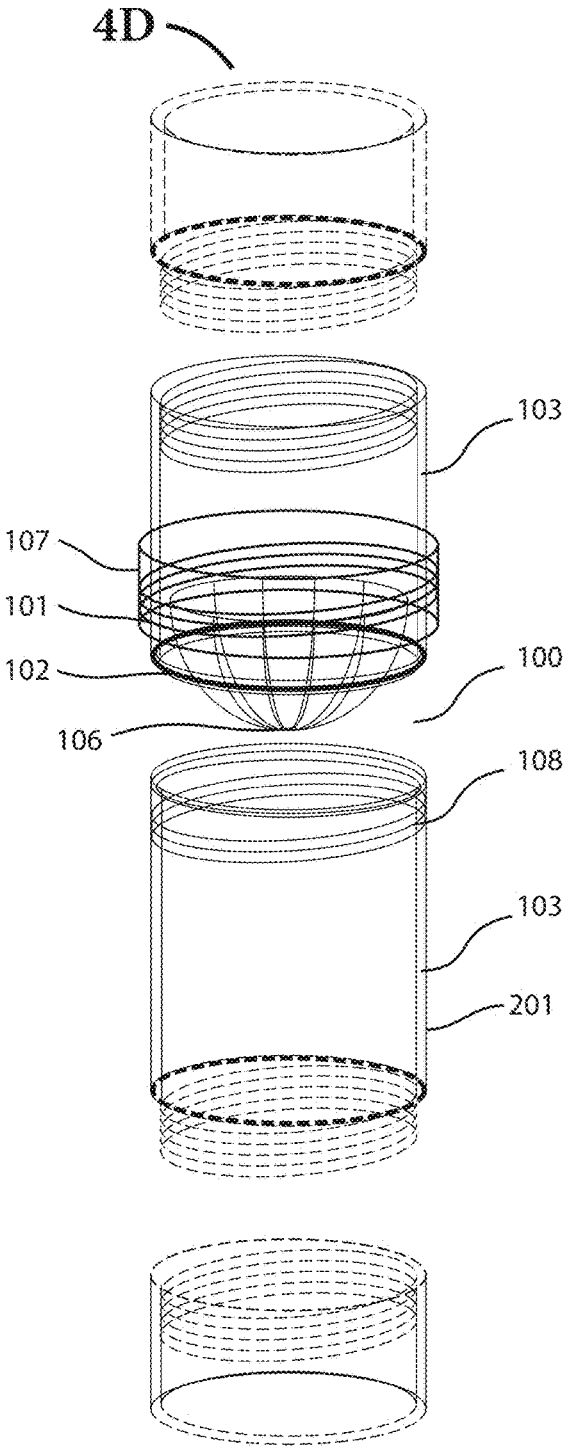
FIG. 8 illustrates an exploded view showing a strainer, rotational locking mechanism, and detachable segments.

FIG. 7 and FIG. 8 detail Combination Module (4D), incorporating a modular filtration insert (106) and the modular detachment interface (100). The modular filtration insert (106) is secured within the mid-section and is easily removable for cleaning. The rotational locking mechanism (107) ensures the filtration insert remains in place during use while allowing for quick assembly and disassembly. This module highlights the system's adaptability to accommodate filtration and mixing functionalities within a single design.

Figure 9:
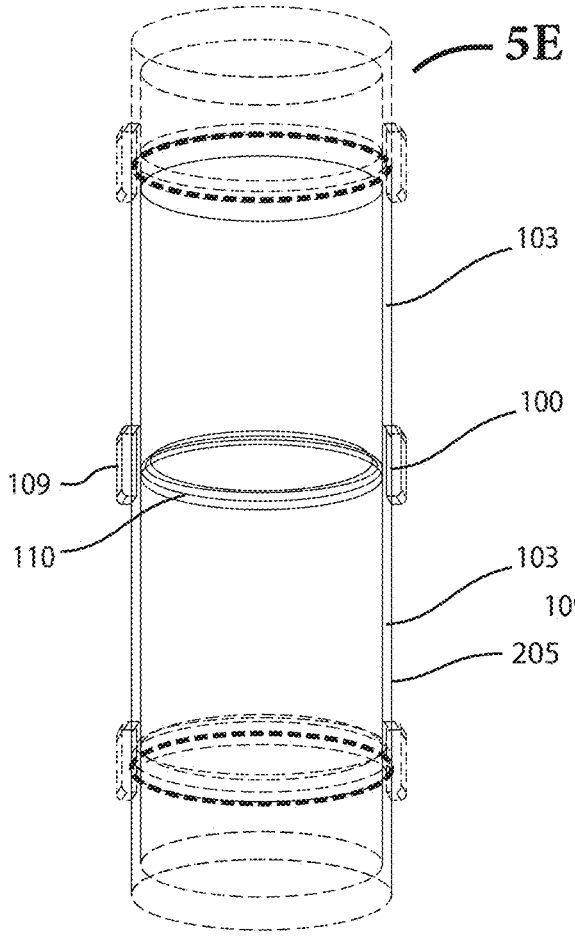
FIG. 9 illustrates a thermal insulated soup container variant using the mid-section detachment interface.
Figure 10:
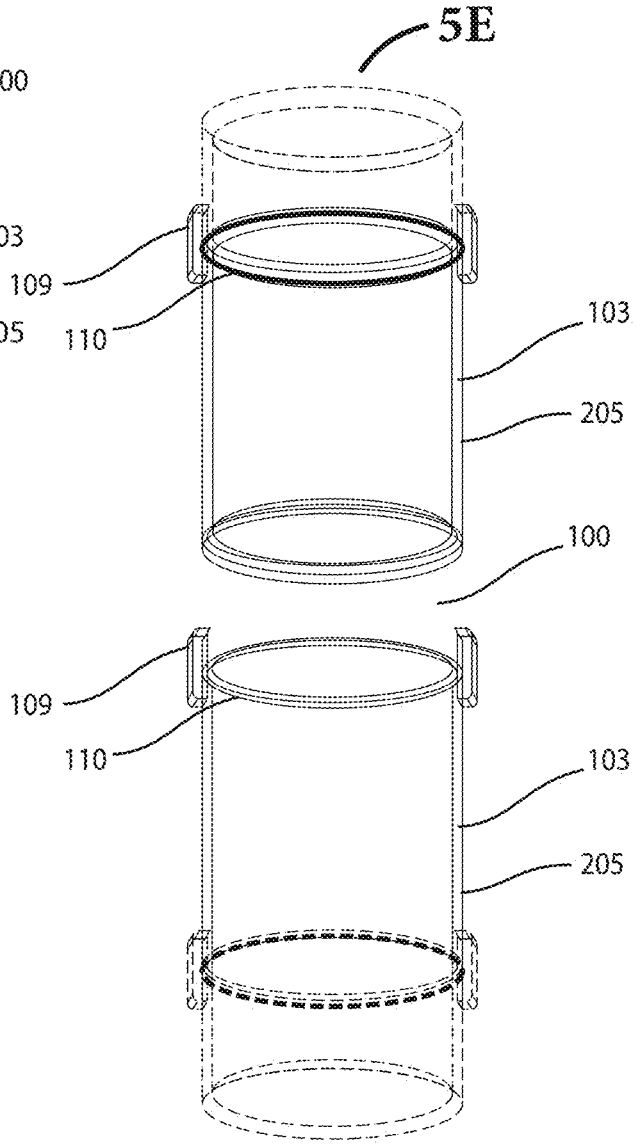
FIG. 10 illustrates an exploded soup container with magnetic sealing and modular clip-lock mechanisms.

FIG. 9 and FIG. 10 showcase Combination Module (5E), a soup container with thermal insulation wall (103) and the modular detachment interface (100). The base module with magnet and clip lock (205) features a magnetic sealing system (110) and modular clip-lock mechanism (109) for secure handling. This configuration demonstrates the adaptability of the system for hot liquid storage and easy cleaning.

Figure 11:
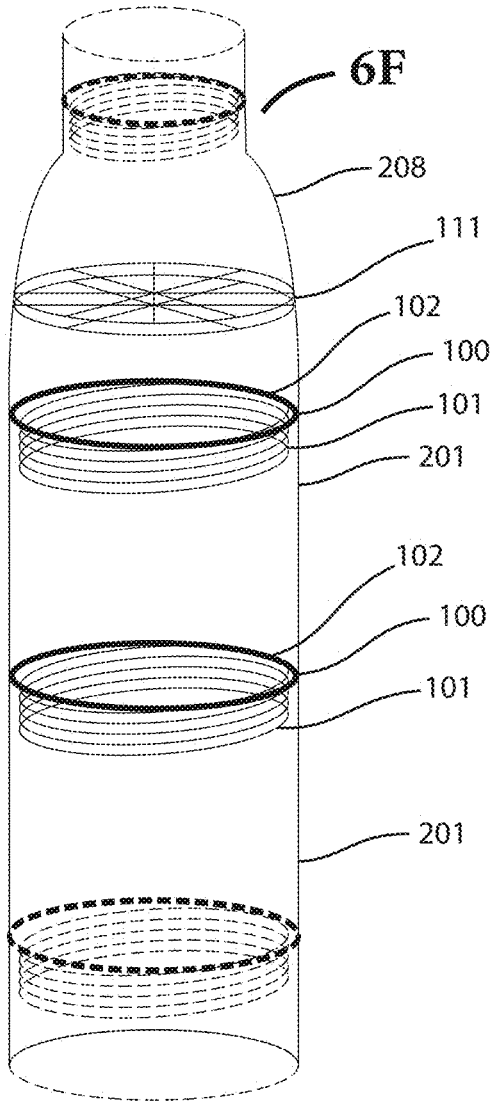
FIG. 11 illustrates a shaker bottle configured with powder agitator and modular segments.
Figure 12:
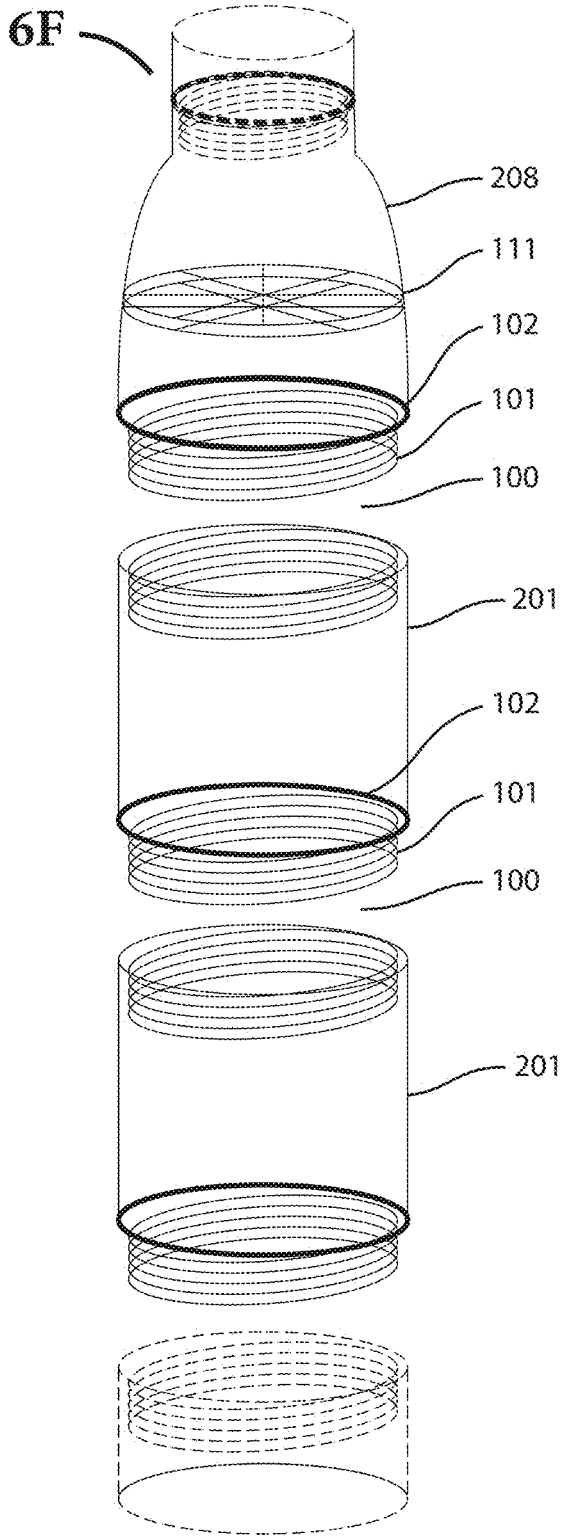
FIG. 12 illustrates an exploded shaker system highlighting modular mix-capable design.

FIG. 11 and FIG. 12 present Combination Module (6F), a shaker bottle equipped with a powder agitator (111) and modular detachment interface (100). The practical module with bottle neck and agitator (208) emphasizes the modular system's adaptability for practical uses. An individual can interchange the bottle neck and agitator (208) module with base module (201) if the agitator is no longer necessary.

Figure 13:
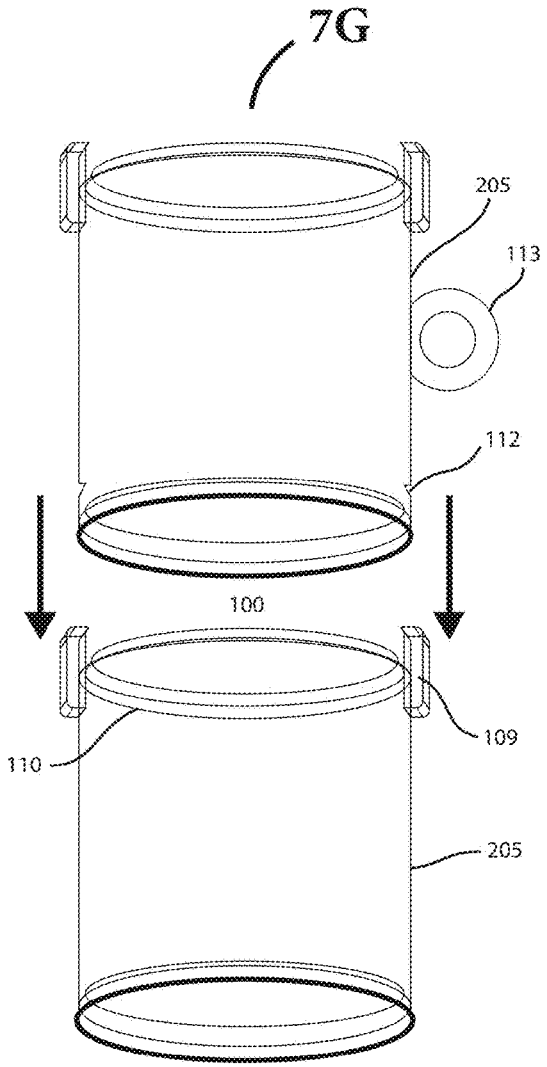
FIG. 13 illustrates a cross-sectional view of a container with magnetic seals and strap attachment.

FIG. 13 depicts Combination Module (7G), a base module with magnetic sealing system (110) and clip locking grooves (112). This design emphasizes secure attachment and modular expansion, allowing additional components such as handles or extended storage sections. The strap attachment (113) enhances portability.

Figure 14:
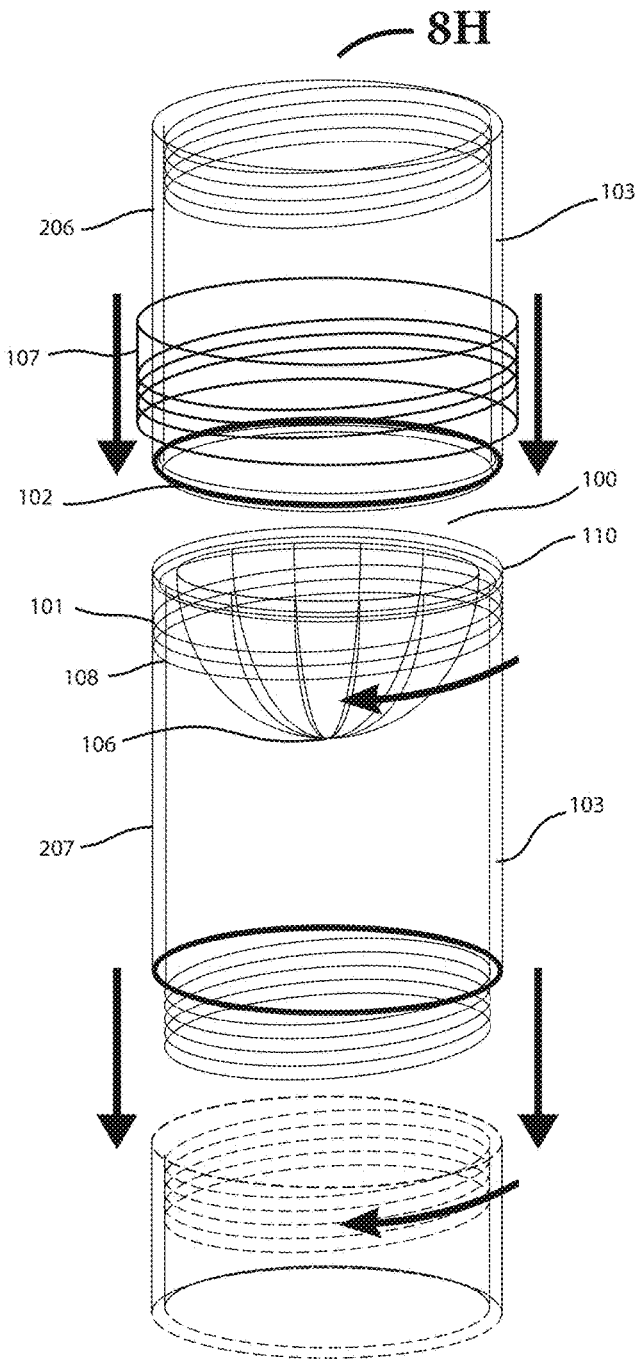
FIG. 14 illustrates a modular filtration insert system for separating solids and liquids within a mid-section coupling.

FIG. 14 highlights Combination Module (8H), hybrid module A (206) and hybrid module B (207), a modular filtration insert (106), and rotational locking mechanisms (107). This setup allows for solid-liquid separation and highlights the reconfigurability and cleanability of the system.

Figure 15:
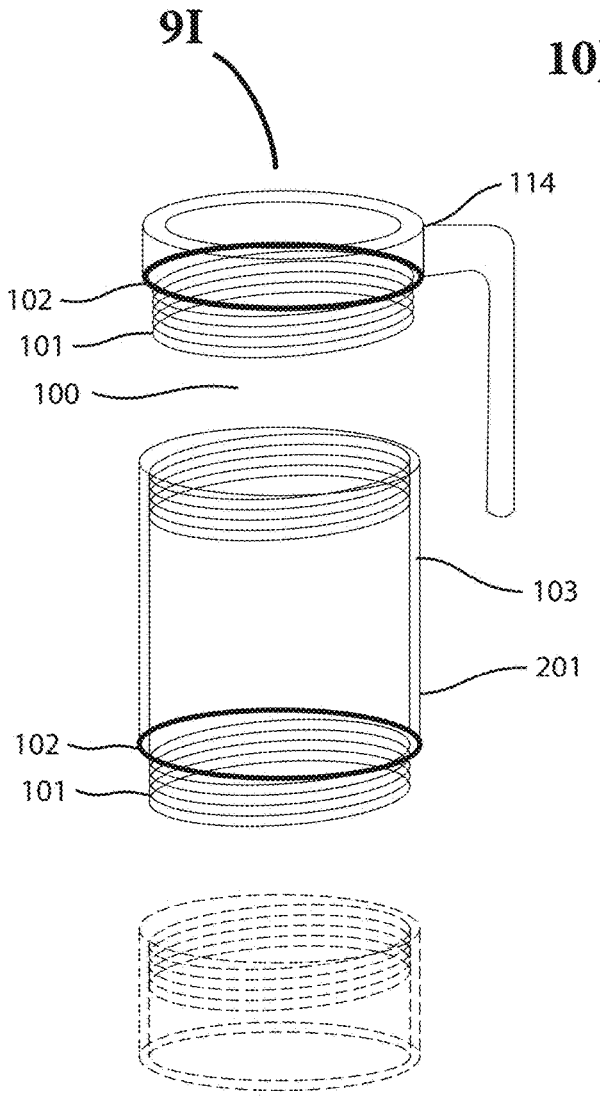
FIG. 15 illustrates a compact modular cup with universal lid and integrated base support.

FIG. 15 illustrates Combination Module (91), an insulated cup configuration derived from a thermal insulation wall (103) module with an integrated lid with grip feature (114). This compact design includes a universal lid or base (115) and an integrated base support or coaster (116). It shows compatibility for modular reassembly.

Figure 16:
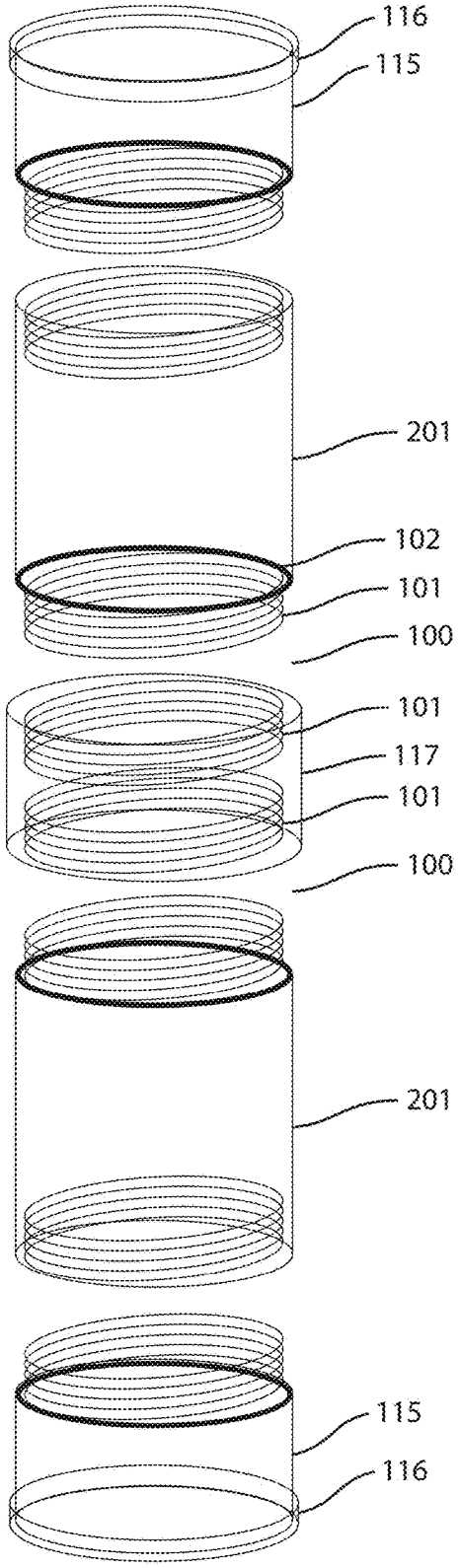
FIG. 16 illustrates a fully expanded modular container system including various coupling and sealing modules.

FIG. 16 demonstrates Combination Module (10J), a fully expanded modular system showcasing multiple possible configurations including the modular detachment interface (100), thread sealing system (101), gasket (102), base modules (201), and a coupling gasket (117). Also shown are the magnetic sealing system (110) and modular clip-lock mechanisms (109).

Each combination module described herein demonstrates the versatility of the modular detachment interface (100). The examples provided are illustrative and do not limit the scope of the invention. Variations may be made by those skilled in the art without departing from the scope of this disclosure.

The modular container system described herein is adaptable for a wide range of applications, including but not limited to personal hydration, baby feeding, athletic supplementation, travel storage, and temperature-sensitive food and beverage transport. The interchangeable components and standardized interfaces allow users to configure, reconfigure, and scale the system for individual lifestyle needs without requiring separate containers for each function. Such versatility reinforces the platform's capability to reduce redundant products while offering customizable solutions.

The invention claimed is:

1. A modular container system comprising:

a plurality of vessel portions, including at least a first vessel portion and a second vessel portion, each having a modular detachment interface;

wherein the first and second vessel portions are detachably couplable via said modular detachment interface;

wherein the modular detachment interface includes an internal coupling system and an external coupling system;

wherein the internal coupling system of the modular detachment interface includes a rotatable securement member;

wherein the external coupling system of the modular detachment interface includes a snap securement member; and wherein at least one vessel portion includes a filtration insert, and wherein the filtration insert includes one or more curved surfaces that extend along a longitudinal axis of said vessel portion.

2. The modular container system of claim 1, wherein said modular container system is adapted to be assembled into at least two different container configurations selected from a bottle, cup, bowl, and food storage unit.

3. The modular container system of claim 1, wherein at least one of the plurality of vessel portions, when detached, is operable as a standalone food or beverage container.

4. The modular container system of claim 1, wherein the rotatable securement member of the internal coupling system comprises a threaded sealing mechanism configured to maintain a leak-proof connection between the first vessel portion and the second vessel portion.

5. The modular container system of claim 1, wherein the snap securement member of the external coupling system comprises a snap-fit sealing mechanism configured to maintain a leak-proof connection between the first vessel portion and the second vessel portion.

6. The modular container system of claim 1, wherein the snap securement member of the external coupling system comprises a magnetic-snap sealing mechanism configured to maintain a leak-proof connection between the first vessel portion and the second vessel portion.

7. The system of claim 1, wherein at least two of the vessel portions are substantially identical and operable as either a base or a top segment of the reconfigured container.

8. The system of claim 1, wherein the vessel portions are made from materials selected from the group consisting of stainless steel, food-grade plastic, glass, aluminum, silicone, and composite polymers.

9. The system of claim 1, wherein at least one vessel portion includes a mixing insert.

10. The system of claim 1, wherein the assembled container includes a base module, a middle vessel segment, and a detachable top, all detachably connectable to one another.

11. The modular container system of claim 1, wherein at least one vessel portion includes an electronic sensor integrated within the vessel portion and configured to monitor contents of the container.

12. The modular container system of claim 1, wherein the system further comprises an external fastener positioned between the first vessel and the second vessel to secure them together.

13. The modular container system of claim 12, wherein the external fastener is configured to receive and at least partially conceal a portion of the first vessel and the second vessel.

14. A modular container system comprising:

a base vessel member having a closed first end configured to hold a fluid, and an open second end configured for removably coupling to a body vessel member;

one or more body vessel members having a first end for removably coupling to the base vessel member, and a second end for removably coupling to additional body vessel members and a lid vessel member, and the lid vessel member having a first end configured to couple to the body vessel member and a second end configured for opening and closing the modular container system;

wherein the base, body, and lid vessel members are removably coupled to one another through a modular detachment interface;

wherein the modular detachment interface includes an internal detachment system having a threaded sealing mechanism configured to maintain a leak-proof connection between one or more vessel portions, and an external detachment system having a snap-fit sealing mechanism configured to maintain a leak-proof connection between one or more vessel portions; and wherein at least one vessel portion includes an accessory insert, and wherein the accessory insert includes one or more curved surfaces that extend along a longitudinal axis of said vessel portion.

15. The modular container system of claim 14, wherein the snap-fit sealing mechanism comprises a magnetic-snap sealing member.

16. The modular container system of claim 14, wherein the accessory insert is selected from the group consisting of a filtration member, a mixing member, and a sensor member.

17. The modular container system of claim 14, wherein at least one vessel member includes an electronic sensor integrated within the vessel member and configured to monitor contents of the container.

18. A modular container system comprising:

a plurality of vessel portions, including at least a first vessel portion and a second vessel portion, each having a modular detachment interface;

wherein the first and second vessel portions are detachably couplable via said modular detachment interface;

wherein the modular detachment interface includes an internal coupling system and an external coupling system;

wherein the internal coupling system of the modular detachment interface includes a rotatable securement member;

wherein the external coupling system of the modular detachment interface includes a snap securement member;

wherein the system further comprises an external fastener positioned between the first vessel and the second vessel to secure them together; and wherein the external fastener is configured to receive and at least partially conceal a portion of the first vessel and the second vessel;

wherein at least one vessel portion includes a modular insert interface configured to removably receive an accessory member.

19. The modular container system of claim 18, wherein the modular insert interface is unoccupied, and the modular container system is operable as a standard beverage vessel.

20. The modular container system of claim 18, wherein the modular insert member is selected from the group consisting of a filtration member, straining member, mixing member, infusing member, and sensor member.

* * * * *